US006617501B2

(12) United States Patent
Kaufmann

(10) Patent No.: US 6,617,501 B2
(45) Date of Patent: Sep. 9, 2003

(54) CYMBAL SYSTEM

(75) Inventor: Otto Kaufmann, Neustadt/Aisch (DE)

(73) Assignee: Roland Meinl Musikinstrumente GmbH & Co., Neustadt/Aisch (DE)

( * ) Notice: Subject to any disclaimer, the term of this patent is extended or adjusted under 35 U.S.C. 154(b) by 0 days.

(21) Appl. No.: 09/998,194

(22) Filed: Dec. 3, 2001

(65) Prior Publication Data

US 2002/0066356 A1 Jun. 6, 2002

(30) Foreign Application Priority Data

Dec. 2, 2000 (DE) ..... 00 126 356

(51) Int. Cl.[7] ..... G10D 13/02
(52) U.S. Cl. ..... 84/422.3; 84/422.2
(58) Field of Search ..... 84/422.3, 422.2

(56) References Cited

U.S. PATENT DOCUMENTS 3,640,029 A * 2/1972 Zildjian ..... 451/53
6,034,313 A * 3/2000 Shelley ..... 84/422.3

FOREIGN PATENT DOCUMENTS

DE 19848459 * 9/1999

* cited by examiner

*Primary Examiner*—Shih-yung Hsieh
(74) *Attorney, Agent, or Firm*—Browdy and Neimark, P.L.L.C.

(57) ABSTRACT

In a cymbal system (1, 1", 8, 15) comprising at least one cymbal (1), successive elevations (6) and indentations (7) are formed on the curved cymbal (1) in the circumferential direction. The elevations (6) and indentations (7) extending in the circumferential direction are disposed at a distance R2 from the outer edge (3) of the main body (1').

This waviness allows the compressed air to escape when the upper and lower cymbal are struck together when they are played. A retarding air cushion does not form and a clear, hard sound is generated.

9 Claims, 1 Drawing Sheet

CYMBAL SYSTEM

BACKGROUND OF THE INVENTION

1. Field of the Invention

The invention is directed to a cymbal system comprising at least one cymbal that incorporates a curved main body and a central bore for disposition on a vertical stand, wherein successive elevations and/or indentations are formed on the curved main body in the direction of its circumference.

2. Background Art

In one known cymbal system of this type, a conventionally designed, upwardly concave cymbal is combined with an upwardly convex cymbal that has a wavy outer edge. The purpose of the waviness is that when the upper and lower cymbal make contact due to their relative movements in the axial direction when they are played, air from the interior space between the two cymbals, which is compressed by their movement, can escape radially to the outside, so that no retarding air cushion is formed and a clear, hard sound is ensured.

Also known are cymbal systems wherein a central, stationary cymbal is provided on a vertical stand, and an upper cymbal of a smaller diameter and a lower cymbal of a larger diameter are struck against it when they are played, due to an appropriate drive mechanism via a foot pedal.

It is known, as a rule, to design the main body of such cymbals wavy, as seen in the radial direction, i.e., circular elevations and indentations exist in the top view.

SUMMARY OF THE INVENTION

With this known prior art as the starting point, the invention has as its object to improve a cymbal system of the above type in such a way that completely novel sound effects can be achieved, which are suitable particularly for a newly developed trend among musical styles, the "Drum'n Bass".

This object is met according to the invention in such a way that the elevations and indentations that extend in the circumferential direction are disposed at a distance from the outer edge of the main body.

According to the invention, successive elevations and indentations are thus provided in the circumferential direction on the inner portion of the main body, which, in combination with a second cymbal disposed on top thereof, result in a completely new, slightly rattling or jazzy sound effect, particularly when the cymbal system is struck with the shaft of a drum stick. The prerequisite for this is that two cymbals of this type are not tightly fastened in the axial direction but that a certain axial play is ensured and this axial play can be adjustable in a manner known per se, and the effect is more or less pronounced, depending on that adjustment.

A further embodiment of the invention advantageously provides for the cymbal system to comprise two cymbals of different diameters, with the elevations and indentations formed on the larger diameter cymbal and extending radially from the central opening to the region of the outer edge of the smaller cymbal, and with the two cymbals both formed upwardly convex.

Provision may furthermore advantageously be made for the smaller diameter cymbal to have elevations and/or indentations in the region of its outer edge, for the elevations and/or indentations to be designed approximately wave-like in cross-section, for at least one cymbal that is formed upwardly concave to be provided at the underside of the system.

A cymbal located on top is advantageously provided with elevations and indentations in its edge region, with a spacing of the elevations and indentations that is different from the spacing of the elevations and indentations in the central region of the main body of a cymbal disposed beneath it.

Details of the invention will become apparent form the ensuing description of preferred exemplary embodiments, taken in conjunction with the drawing.

DESCRIPTION OF THE PREFERRED EMBODIMENTS

Figure 1:
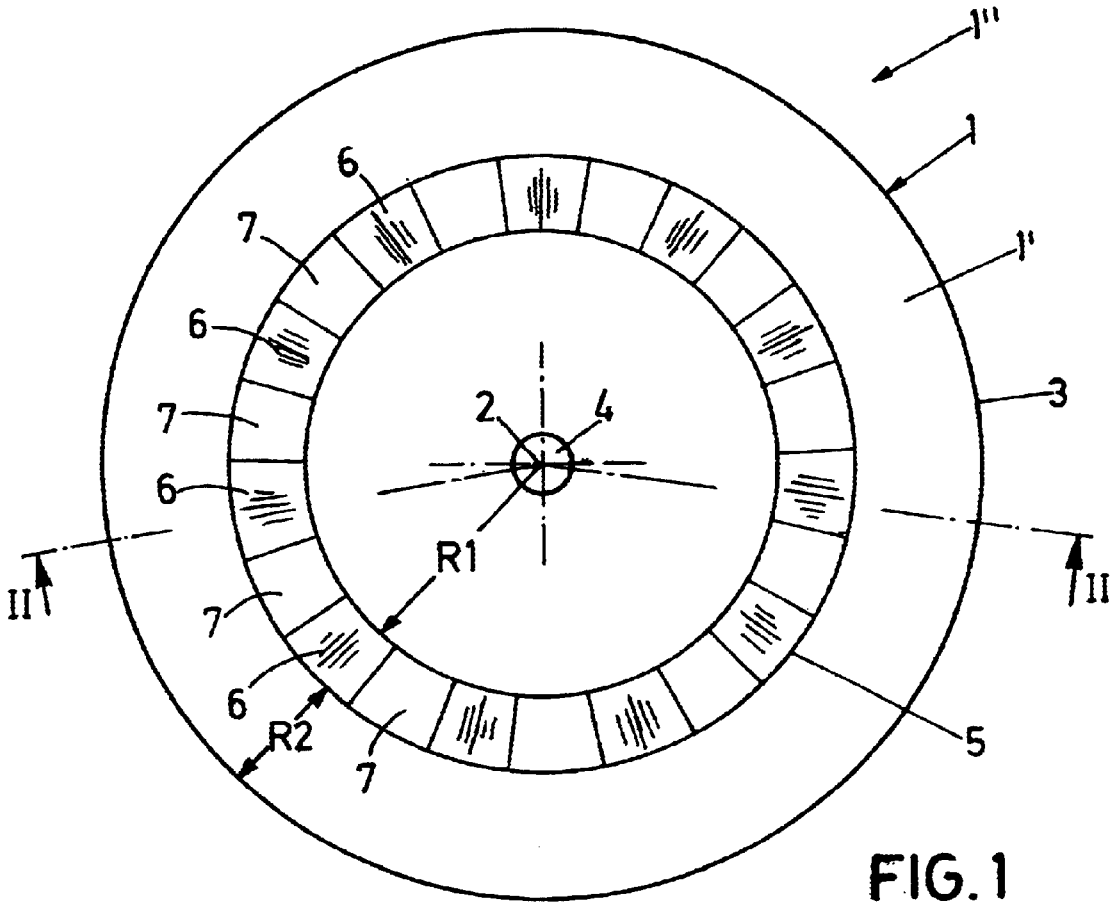
FIG. 1 showing a top view of a single inventive cymbal.

FIG. 1 shows a cymbal system 1" that comprises a round cymbal 1. The cross-section of a main body 1' is convex, i.e., the center 2 of the cymbal 1 is higher than its outer edge 3. A central bore 4 is positioned in the center of the cymbal 1.

A region 5 that is concentric thereto, with periodically alternating elevations 6 and indentations 7, is located at a radial distance R1 from the center 2. The elevations 6 and the indentations 7, accordingly, are thus formed wave-like. The elevations 6 and indentations 7 all have the same dimensions, both in length and width as well as in depth, and are oriented radially. The concentric region 5 has a distance R2 from the outer edge 3.

Figure 2:
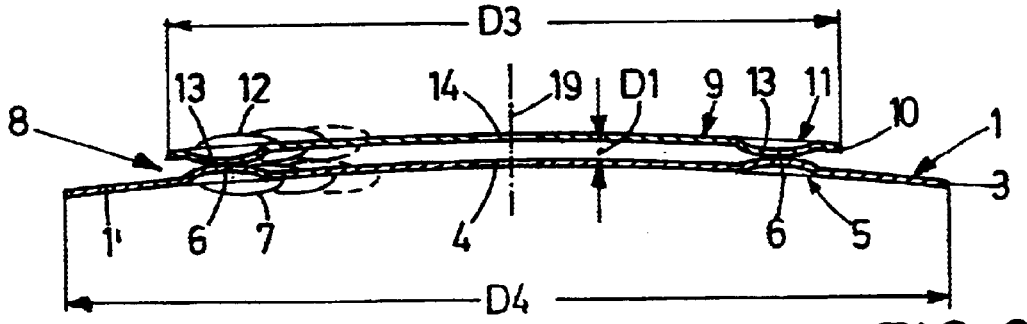
FIG. 2 showing an inventive cymbal system.

FIG. 2 shows a cymbal system 8 that comprises a second cymbal 9, which incorporates directly at its edge 10 a region 11 with alternating elevations 12 and indentations 13. The indentations 7 of the cymbal 1 and the elevations 12 of the cymbal 9 are shown in FIG. 2 only in the left half of the figure. The region 11 is concentric relative to the central bore 14.

The second cymbal 9 is also round and, like cymbal 1, convex. The cymbal 9 has a diameter D3 that is smaller than that of cymbal 1.

The two central bores 4 and 14 have a common axis 19.

The diameters D4 and D3 of the cymbals 1 and 9 and the positions of the regions 5 and 11 with the respective elevations 6, 12 and indentations 7, 13 on the respective cymbals 1, 9, are selected such that the elevations 6, 12 and indentations 7, 13 are located directly over one another. The elevations 6 of the cymbal 1, in the system shown in FIG. 2, make contact with the indentations 13 of the second cymbal 9.

As a result, a spacing D1 exists between the two cymbals 1 and 9, which is dependent upon the height of the elevations 6 of the cymbal 1 and the depth of the indentations 13 of the second cymbal 9.

Figure 3:
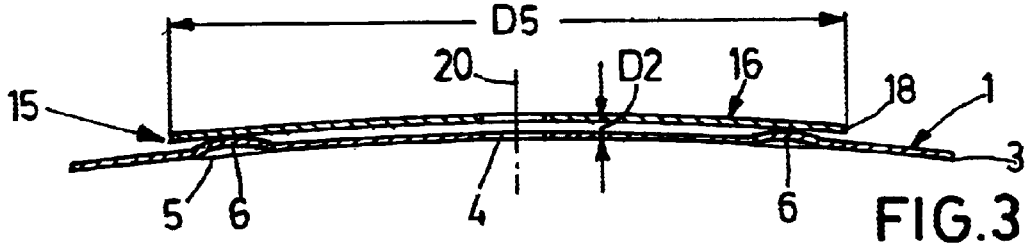
FIG. 3 showing a further inventive cymbal system.

FIG. 3 shows a further possible system 15, which comprises a second cymbal 16 that does not incorporate any elevations and indentations.

The second cymbal 16 is also round and the convex curvature of the second cymbal 16 is nearly identical with the curvature of the cymbal 1.

The outer diameter D5 of the second cymbal 16 shall be selected such that the outer edge 18 of the second cymbal 16 ends shortly after the concentric region 5 of the cymbal 1.

The cymbals 1 and 16 have a common axis 20. The spacing D2 is dependent upon the height of the elevations 6. An air cushion can thus form between the cymbals 1 and 16.

What is claimed is:

1. A cymbal system (1, 1", 8, 15) comprising at least one cymbal (1) having a curved main body (1') and a central bore (4) for disposition on a vertical stand, wherein successive elevations (6) and/or indentations (7) are formed on the curved main body (1') in the direction of a circumference thereof, wherein the elevations (6) and indentations (7) that extend in the circumferential direction are disposed at a distance (R2) from the outer edge (3) of the main body (1');

wherein the cymbal system comprises two cymbals (1, 16) of different diameters D4, D5, wherein the elevations (6) and indentations (7) are formed on the cymbal (1) with the larger diameter (D4) and extend radially from the central bore (4) to the region of an outer edge (18) of the cymbal (16) with the smaller diameter (D5), and wherein the two cymbals (1, 16) are both curved upwardly convex.

2. A cymbal system (8) according to claim 1, wherein the cymbal (9) with the smaller diameter D3 has elevations (12) and/or indentations (13) in the region (11) of an outer edge (10) thereof.

3. A cymbal system according to claim 1, wherein the elevations (6, 12) and/or indentations (7, 13) are designed approximately wave-like in cross-section.

4. A cymbal system according to claim 1, wherein said at least one cymbal (1) that is curved upwardly convex is provided at an underside of the system (8, 15).

5. A cymbal system (1, 1", 8, 15) comprising a first cymbal (1) having a curved main body (1') and a central bore (4) for disposition on a vertical stand, wherein successive elevations (6) and/or indentations (7) are formed on the curved main body (1') in the direction of a circumference thereof, wherein the elevations (6) and indentations (7) that extend in the circumferential direction are disposed at a distance (R2) from the outer edge (3) of the main body (1');

wherein a second (9) located above the first cymbal has elevations (12) and indentations (13) in an edge region (11) thereof, spacing of said elevations (12) and indentations (13) being different from spacing of the elevations (6) and indentations (7) in the central region of the main body (1') of the first cymbal (1).

6. A cymbal system (15) according to claim 5, wherein the cymbal system comprises two cymbals (1, 16) of different diameters D4, D5, wherein the elevations (6) and indentations (7) are formed on the first cymbal with the larger diameter (D4) and extend radially from the central bore (4) to a region of an outer edge (18) of the second cymbal (16) with the smaller diameter (D5), and wherein the two cymbals (1, 16) are both curved upwardly convex.

7. A cymbal system (8) according to claim 6, wherein the second cymbal (9) with the smaller diameter (D3) has elevations (12) and/or indentations (13) in a region (11) of an outer edge (10) thereof.

8. A cymbal system according to claim 5, wherein the elevations (6, 12) and/or indentations (7, 13) are designed approximately wave-like in cross-section.

9. A cymbal system according to claim 5, wherein said first cymbal (1) that is curved upwardly convex is provided at an underside of the system (8, 15).

* * * * *

UNITED STATES PATENT AND TRADEMARK OFFICE

CERTIFICATE OF CORRECTION

PATENT NO. : 6,617,501 B2
DATED : September 9, 2003
INVENTOR(S) : Kaufmann

It is certified that error appears in the above-identified patent and that said Letters Patent is hereby corrected as shown below:

Title page,
Item [30], Foreign Application Priority Data, delete "(DE)" and insert therefor -- (EP) --.

Signed and Sealed this

Twenty-fourth Day of February, 2004

JON W. DUDAS
*Acting Director of the United States Patent and Trademark Office*